United States Patent [19]

Rice et al.

[11] Patent Number: 4,684,259

[45] Date of Patent: Aug. 4, 1987

[54] EPOXY MIXING AND DISPENSING APPARATUS

[75] Inventors: Steven J. Rice, Lakewood; Gilbert M. Thompson, Littleton; Michael W. Dolph, Lakewood; Daniel D. Montoya, Brighton, all of Colo.

[73] Assignee: Adolph Coors Company, Golden, Colo.

[21] Appl. No.: 762,495

[22] Filed: Aug. 5, 1985

[51] Int. Cl.[4] ..... B01F 9/10; B01F 15/02

[52] U.S. Cl. ..... 366/185; 366/213; 366/224; 366/235

[58] Field of Search ..... 366/185, 187, 189, 194, 366/213, 235, 241, 279, 224, 14, 198

[56] References Cited

U.S. PATENT DOCUMENTS

| | | | |
|---|---|---|---|
| 1,463,744 | 7/1923 | Lauterbur | 366/198 |
| 1,504,832 | 8/1924 | Pouget | 366/213 |
| 2,104,456 | 1/1938 | Friedman | 366/213 X |
| 2,562,310 | 7/1951 | Frohring | 366/14 |
| 2,573,296 | 10/1951 | Arant | 366/47 |
| 2,651,582 | 9/1953 | Courtney | 366/224 X |
| 3,251,579 | 5/1966 | Lasar | 366/185 |
| 4,299,500 | 11/1981 | Bassetti | 366/198 |

FOREIGN PATENT DOCUMENTS

| | | | |
|---|---|---|---|
| 1122827 | 9/1956 | France | 366/224 |
| 128454 | 12/1928 | Switzerland | 366/224 |

*Primary Examiner*—Harvey C. Hornsby
*Assistant Examiner*—Scott J. Haugland
*Attorney, Agent, or Firm*—Klaas & Law

[57] ABSTRACT

An epoxy mixing and dispensing apparatus for continuously mixing epoxy and dispensing it to a surface to be coated including: a movable carriage; a first dump bucket assembly mounted at a first end portion of said carriage for rotating and dumping a first bucket; a second dump bucket assembly mounted at a second end of said carriage for rotating and dumping a second bucket; an epoxy mixing assembly having a power driven epoxy mixer for mixing epoxy ingredients in said buckets; mixer placement and support apparatus for facilitating movement of said mixer between said buckets and for supporting said mixer in various operation positions; and controls for independently controlling first and second power driven bucket rotation devices and said power driven epoxy mixer.

7 Claims, 7 Drawing Figures

M
60
50
10
Z
122
70
62
64
72
129
68
156
36
66
40
154
152
158
124
38
134
132
130
82
126
144
128
86
174
84
176
152
146
30
116
178
C
52
108
M
104
A
77
150
76
74
80
136
C
172
76
148
142
AA
114
78
98
140
102
139
X
34
149
A
106
118
88
96
90
120
94
92
112
4
138
26
110
22
24
19
4
12

20
16
32
X
Z
18

EPOXY MIXING AND DISPENSING APPARATUS

BACKGROUND OF THE INVENTION

The present invention relates generally to the mixing of epoxy resins and the like and, more particularly, to a machine which facilitates continuous mixing and dispensing of epoxy for industrial applications such as the coating of concrete floors and the like.

Among other uses, epoxy is used to treat concrete floors and other surfaces to provide a hard, smooth floor finish. In order to provide the epoxy, which is applied to the surface to be treated, epoxy resins are initially mixed with a catalyst and/or other ingredients. The epoxy resins solidify and form a physical bond with the floor or other surface being treated. Due to the fact that the various epoxy constituents, once mixed, solidify in a relatively short period of time, it is necessary to mix the epoxy in relatively small batches, one batch at a time, during the operation in which the epoxy is being applied.

Until the present invention, this epoxy batch preparation process was usually performed by one or two men using a plurality of five gallon buckets and a hand held mixer. After mixing of the epoxy material in each bucket, the mixed epoxy is carried to and spread onto floor areas to be covered. The epoxy poured onto the floor is subsequently spread evenly into place by other workmen using notched trowels.

Both the mixing of epoxy and the transporting and pouring of epoxy, as above described, is a labor intensive operation requiring a considerable amount of stoop labor. The mixing and dispensing of epoxy in this manner also has led to inefficient use of personnel due to the fact that the workers spreading the epoxy are often forced to wait as a new batch of epoxy is being prepared.

Thus, it would be generally desirable to provide an apparatus capable of mixing and dispensing epoxy in a continuous manner but without wasting epoxy. It would also be desirable to provide such a machine which can be efficiently operated by a single operator and which allows the operator to support several, e.g. six or more workers spreading the epoxy.

SUMMARY OF THE INVENTION

The present invention comprises an epoxy mixing and dispensing apparatus comprising a pair of rotatable mixing bucket assemblies mounted on a movable carriage. Each mixing bucket assembly is independently dumpable and is provided with a power driven rotation means for rotating the associated bucket about its central longitudinal axis. A mixing assembly is mounted between the two mixing bucket assemblies, and comprises a mixer which may be supported entirely on a central post and which may be conveniently moved from mixing bucket to mixing bucket with little effort by the operator. The mixer assembly has a mixer blade which rotates in the direction opposite the direction of rotation of each bucket, thereby facilitating complete mixing of the various epoxy constituents. In operation, one of the mixing buckets is loaded with various epoxy constituents and the mixer is thereafter placed in a position such that the mixer blade mixes the epoxy in the first bucket as the bucker counter rotates. As the epoxy in the first mixing bucket is being mixed, epoxy constituents may be loaded into the second mixing bucket by the operator. After a few minutes of mixing, the operator moves the mixer from the first bucket to the second bucket. As the epoxy in the second mixing bucket is being mixed, the first mixing bucket of mixed epoxy may be dumped into a transport bucket for transport to the area of a floor where the epoxy material is to be used. After the epoxy in the first mixing bucket is completely dumped into a work bucket, the first mixing bucket is again reloaded with epoxy constituents and the mixer is moved from the second mixing bucket to the first mixing bucket. Thereafter the second mixing bucket may be dumped into another separate transport bucket.

It has been found that use of the present invention by a single operator who loads the epoxy, operates the mixer and dumps the epoxy may support approximately six other workers who are applying the epoxy to a floor area. In the presently preferred embodiment of the invention, the mixing bucket assemblies each have a capacity of about ten gallons. However, larger or smaller mixing bucket assemblies might be used and are within the scope of the present invention.

DETAILED DESCRIPTION OF THE INVENTION

Figure 1:
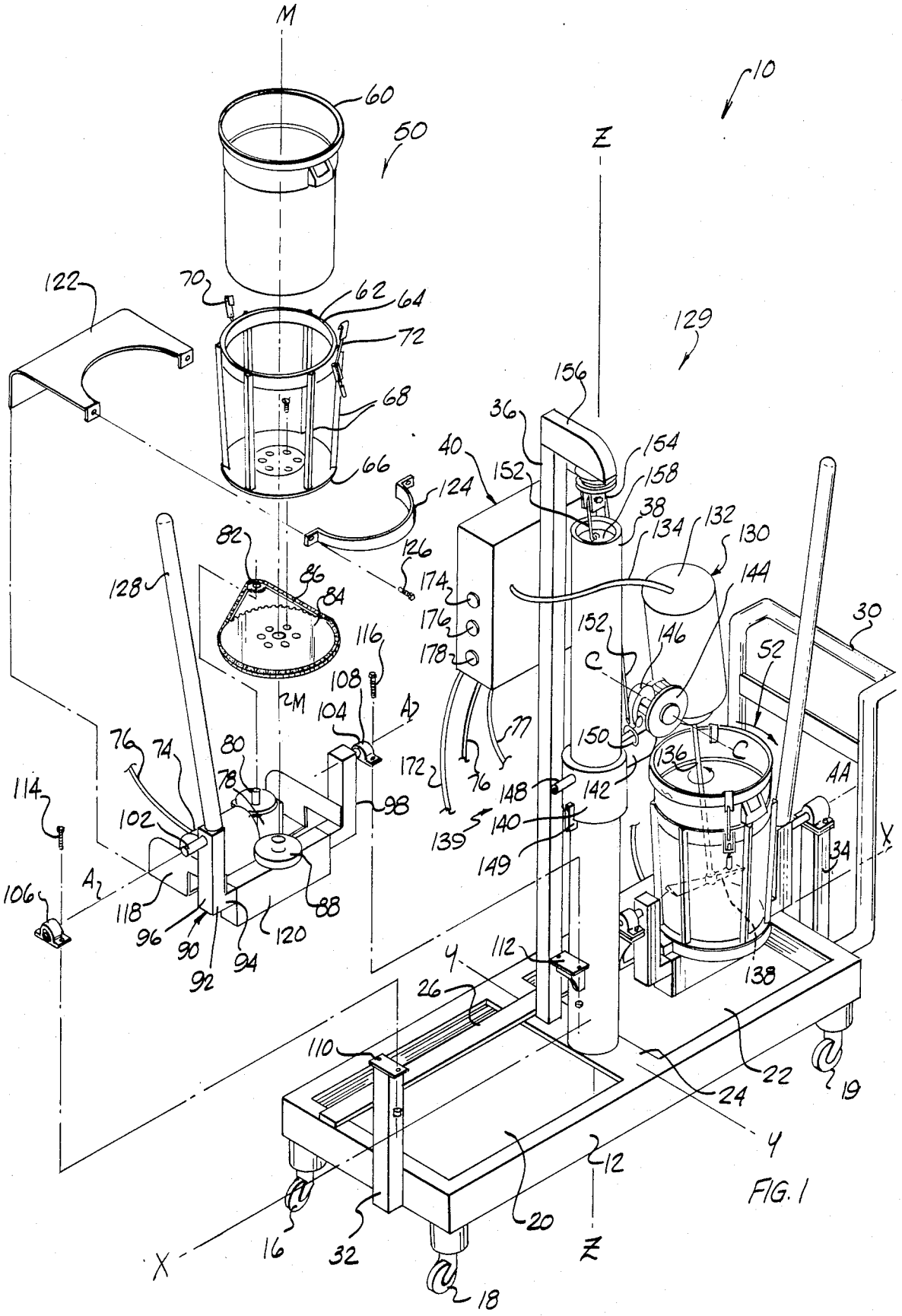
FIG. 1 is a partially exploded perspective view of the epoxy mixing and dispensing apparatus of the present invention.

As illustrated in FIG. 1, the epoxy mixing and dispensing apparatus 10 of the present invention comprises a carriage means which may be a rectangular frame 12 having a central longitudinal axis XX and a central transverse axis YY. The rectangular frame 12 may be supported upon a plurality of caster wheels 14, 16, 18, 19. The frame 12 may include a pair of rectangular open portions 20, 22 defined by the outer periphery of the frame 12 and a transversely extending central frame portion 24. A longitudinally extending support member 26 crossing over a rearwardly positioned portion of the openings 20, 22 may act as a stop means to prevent rearward rotation of associated mixing bucket means, as described in further detail hereinafter. A carriage handle 30 may be fixedly attached to one end of the rectangular frame 12 to facilitate movement thereof. A first and second end post 32, 34 may be fixedly attached as by bolts, welding or the like, to opposite longitudinal ends of the rectangular frame 12 and may be longitudinally aligned with a central tubular guide post 38 fixed mounted on central frame portion 24 which forms a portion of the mixing assembly, as described in further detail hereinafter. A central support post 36 may be positioned rearwardly of the central tubular guide post 38 and may act to support a counterweight 158 through a pulley 154 pivotally mounted on a traverse beam portion 156 thereof. The central support post 36 may also support an electrical power and control box 40, as described in further detail hereinafter.

A first and second dumpable mixing bucket assembly 50, 52 are provided above the frame rectangular open portions 20, 22, respectively. First mixing bucket assembly 50 is shown in exploded form and will be further described in detail. The second mixing bucket assembly may comprise a mirror image of the first mixing bucket assembly and may include exactly the same structural components as the first mixing bucket assembly. Additional mixing bucket assemblies may be employed as necessary or desirable.

The first dump bucket assembly comprises a bucket 60 supported in a cylindrical bucket frame 62 having an upper rim portion 64 and a circular base portion 66 fixedly connected by a plurality of axially extending circumferentially spaced ribs 68. Adjustable clamps 70, 72 are provided on rim portion 64 to clappingly secure the bucket 60 to the cylindrical bucket frame 62.

A power driven bucket rotation means is provided to rotate the bucket assembly 50 about its central longitudinal axis MM. The power driven bucket rotation means may comprise a conventional electric motor 74 such as, for example, a Reliance, 3 Phase, Turntable Motor Type P-F.R. K56C, or other conventional electric motors well known in the art. The electric motor receives power from a power line 76 from power and control box 40. A gear box 78 may be associated with the electric motor 74 for drivingly rotating a drive shaft 80 about a vertical axis. The drive shaft 80 may have mounted thereon a first gear 82 drivingly linked to a second gear 84 by a drive chain 86. Second gear 84 may be fixedly mounted on a mounting disc 88 which is rotatably mounted on a pivotal dumping assembly 90.

The pivotal dumping assembly may comprise a U-shaped member 92 having a central portion 94 extending longitudinally of the frame and having a pair of normally vertically extending arm portions 96, 98. Each arm portion 96, 98 has a longitudinally extending pivot shaft 102, 104 fixedly attached thereto which is, in turn, mounted in an associated bearing member 106, 108. Bearing members 106, 108 are supported on horizontal attachment plates 110, 112 fixedly attached to first end post 32 and central tubular guide post 38, respectively. Bearing members 106, 108 may be fastened as by attachment bolts 114, 116 or other conventional attachment means well known in the art. A motor support bracket 118 is fixedly attached to U-shaped member 92 and fixedly supports electric motor 74 thereon. A forward motor shield 120 may be attached to U-shaped member central portion 94 and a rear and upper shield member 122 may be fixedly attached to motor support bracket 118 for shielding and enclosing the motor 74. A forward chain shield member 124 may be attached as by bolts 126 to shield member 122. A dump handle 128 is fixedly attached to an upper portion of the outboard positioned arm member 96, and is of a length, e.g. four to six feet, to facilitate relatively easy dumping of the bucket assembly 50 by application of force to an end portion of the handle. Thus, it may be seen that the bucket assembly 50 may be pivoted forwardly to dump the contents thereof by forward movement of handle 128. The handle 128 is preferably mounted with a slight rearward tilt allowing it to be rotated through slightly more than ninety degrees to orient the central axis MM of bucket assembly 50 at a slight downward inclination with respect to a horizontal plane defined by carriage axes XX, YY. The motor support bracket 118 is constructed and arranged such that when bucket axis MM is oriented in a vertical position, the motor support bracket 118 rests in abutting engagement with the frame longitudinally extending support member 26.

A mixer assembly 129 comprising a mixer 130 and a mixer placement and support assembly 139, is provided between the two dump bucket assemblies 50, 52. In the preferred embodiment illustrated in FIG. 1, the mixer 130 includes a variable speed mixer motor 132 which may be, for example, a LIGHNIN XD or JD Series Portable Mixer, manufactured by Mixing Equipment, Inc., 135 Mount Read Boulevard, Rochester, New York, 14611, or other conventional mixer motors well known in the art. Mixer motor 132 is connected to the power supply by a power line 134. A mixer shaft 136 is rotatably driven by the mixer at variable speeds and may have a mixer blade 138 of conventional construction fixedly attached to an end portion thereof. The mixer placement and support assembly 139 may comprise central tubular guide post 38 and a mixer guide sleeve 140 which is slidingly mounted on post 38 such that it may slide vertically along the post or be rotated about the central vertical axis of the post ZZ. Fixedly attached and projecting laterally outwardly from the mixer guide sleeve 140, is a mounting arm 142 which in turn supports a mixer adjustable pivotal attachment device 144 at the terminal end thereof. The attachment device 144 has an outer portion thereof fixedly attached to the mixer motor 130 and has a central pivot pin defining a horizontal pivot axis CC. The adjustable pivotal attachment device may comprise suitable means such as an adjustment nut or ratchet 146 or the like for holding the mixer 130 at various attitudes to facilitate proper placement and support thereof while the mixer is positioned within a bucket, and to facilitate insertion and removal of the mixer from a bucket. A guide sleeve handle 148 may be provided on the guide sleeve diametrically opposite the mounting arm 142 and, in combination with the mounting arm, may be used by an operator to raise and lower the sleeve and thus the attached mixer 130. The guide sleeve 140 is preferably only slightly larger in internal diameter than the external diameter of post 38, e.g. one-eighth inch larger. The weight of the mixer 130 creates a slightly uneven loading of the sleeve in the absence of other force applied thereto, and thus causes the sleeve 140 to bind on the post 38 holding the sleeve and the mixer at a fixed orientation until a person grasping handle 148 and arm 142 aligns the sleeve axis with the central axis ZZ of the post to facilitate vertical sliding movement. Thus the sleeve and post together form a locking assembly which tends to hold the mixer at a fixed orientation whenever it is otherwise unsupported. A sleeve stop 149 may be provided on the post 38 at an elevation such that when the sleeve is positioned at the stop, the blade 138 of the mixer is positioned a few centimeters from the bottom of an associated bucket to facilitate optimum mixing of the epoxy within the bucket. An attachment ring 150 may be mounted on arm 142 and attached to a cable 152 which is, in turn, passed through pulley assembly 154 on beam 156 and attached to counterweight 158 which is slidingly disposed within tubular post 38. The counterweight may be of sufficient weight to offset most of the weight of mixer 130 thus allowing a single operator to easily move the mixer up and down by grasping sleeve handle 148 and mounting arm 142 and moving the sleeve in the desired direction. It will also be seen that the construction of the sleeve and post is such that the mixer 130 after being raised may be easily rotated from a position above one bucket, such as illustrated in FIG. 2, to a position above another bucket as illustrated in FIG. 4.

Electrical power and control box 40 may comprise one or more main power lines 172 providing electrical power thereto and may also comprise a separate on/off switch 174, 176, 178 for the first bucket assembly motor, second bucket assembly and mixer motor, respectively.

Figure 2:
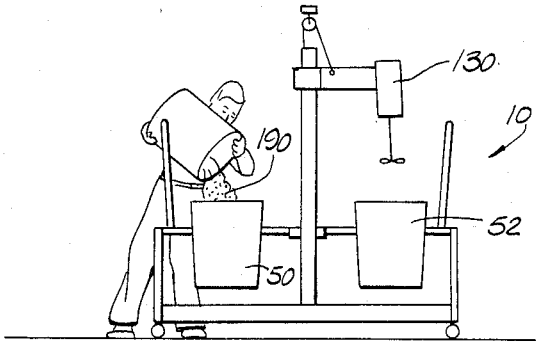
FIGS. 2–7 are schematic frontal views illustrating the operation of the epoxy mixing and dispensing apparatus of FIG. 1.
Figure 3:
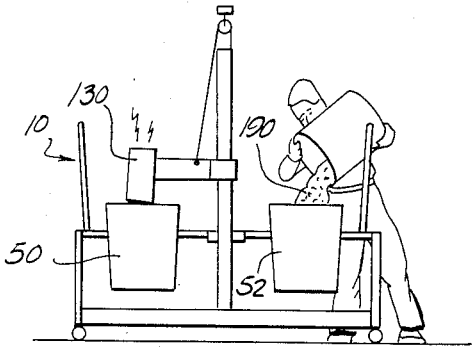
Figure 4:
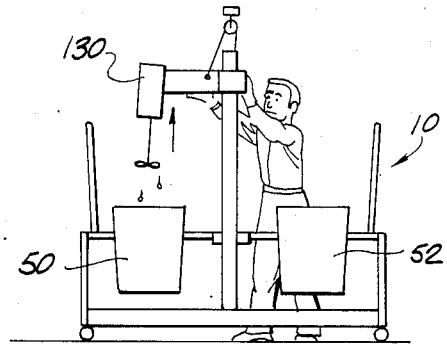
Figure 5:
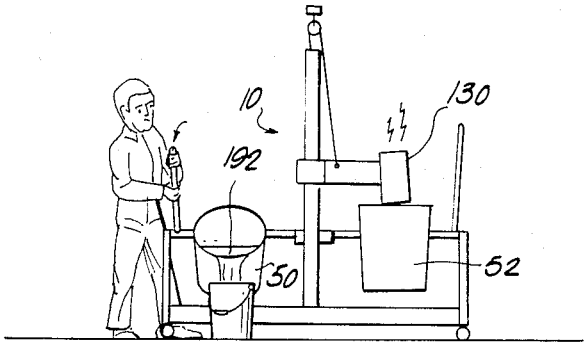
Figure 6:
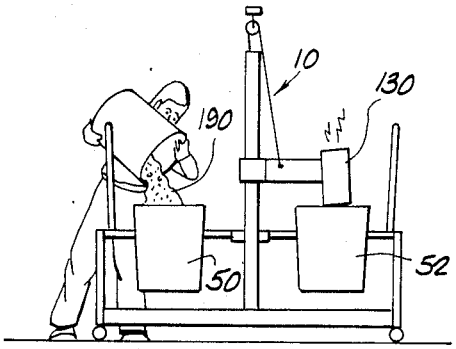
Figure 7:
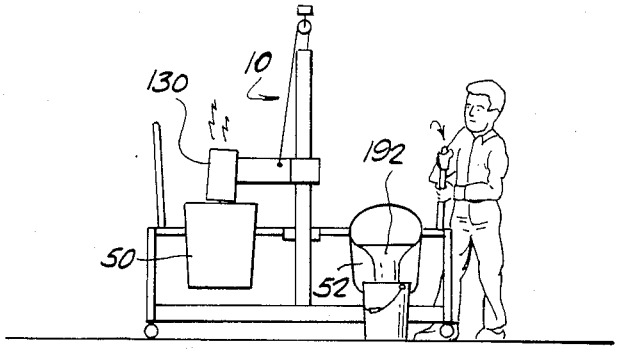

Operation of the epoxy mixing and dispensing apparatus 10 is illustrated in FIGS. 2–7. As illustrated in FIG. 2, an operator initially loads the first mixing bucket assembly 50 with epoxy mixing components 190 with the mixer 130 preferably in a raised position. Thereafter the mixer 130 is positioned in mixing relationship with first bucket assembly 50 and turned on. Next, as shown in FIG. 3, the second bucket assembly 52 is loaded with epoxy mixing components. After continuous mixing for a short period of time, e.g. three to five minutes, the epoxy in the first mixing bucket assembly is ready for use and the mixer 130 is switched off and removed therefrom, as illustrated in FIG. 4. Thereafter the mixer is positioned in mixing relationship with the second mixing bucket assembly 52 and switched on. Mixed epoxy 192 may be dispensed from the first bucket assembly by operation of the associated handle, as illustrated in FIG. 5, while the epoxy in the second bucket assembly is being mixed. The apparatus 10 may be moved to various positions on a floor area to be treated simply by moving the carriage means as by pulling on handle 30, FIG. 1, to cause the carriage means to move to the appropriate position. After epoxy 192 within the first bucket assembly 50 is completely dispensed, the first bucket assembly is reloaded with epoxy mixing components 190, as illustrated in FIG. 6. Thereafter the mixer 130 is moved to mixing relationship with the first bucket assembly and the second bucket assembly 52 may be selectively dumped into transport buckets, FIG. 7. The mixing and dumping operations illustrated in FIGS. 2–7 may thus be continuously performed by a single operator enabling a new batch (bucketful) of epoxy to be prepared and poured approximately every five minutes. At such a rate of performance, a single operator using the apparatus 10 may easily supply mixed epoxy material to six or more workers spreading the epoxy onto the floor. It may thus be seen that the above described apparatus eliminates the need for stoop labor in epoxy mixing, pouring and transporting operations and facilitates rapid mixing and placement of epoxy without unnecessary waste of epoxy or labor.

It is contemplated that the inventive concepts herein described may be variously otherwise embodied and it is intended that the appended claims be construed to include alternative embodiments of the invention except insofar as limited by the prior art.

What is claimed is:

1. An epoxy mixing and dispensing apparatus for continuously mixing epoxy for application to a surface to be coated therewith comprising:

(a) a movable carriage;

(b) a first mixing and dumping bucket assembly mounted at a first end portion of said carriage comprising:

(i) first bucket means having a central bucket axis for receiving epoxy mixing ingredients therein and discharging mixed epoxy therefrom;

(ii) first bucket dumping means having a pivot assembly pivotally mounted on said carriage and a dump handle fixedly attached to said pivot assembly for pivoting said first bucket means about a horizontally disposed dump axis from a normally upright mixing position wherein the central bucket axis is in a substantially vertical orientation to a dumped position wherein the central bucket axis is in a generally horizontal orientation, said bucket means being rotatably mounted on said pivot assembly;

(iii) first power driven bucket rotation means comprising a first electrical motor means operatively linked to said first bucket means for rotating said first bucket means about said central bucket axis for facilitating the mixing of said epoxy ingredients, with said motor means fixedly attached to said pivot assembly whereby said motor means pivots with said first bucket means during pivotal movement of said first bucket dumping means;

(c) a second mixing and dumping assembly mounted at a second end of said carriage comprising:

(i) second bucket means having a central bucket axis for receiving epoxy mixing ingredients therein and discharging mixed epoxy therefrom;

(ii) second bucket dumping means for pivoting said second bucket means about a horizontally disposed dump axis from a normally upright mixing position wherein the central bucket axis is in a substantially vertical orientation to a dumped position wherein the central bucket axis is in a generally horizontal orientation;

(iii) second power driven bucket rotation means for rotating said second bucket means about said central bucket axis for facilitating the mixing of said expoxy ingredients;

(d) an epoxy mixing assembly comprising:

(i) power driven epoxy mixer means selectively insertable into and removable from said first and second bucket means and rotatable in a direction opposite the direction of rotation of said bucket means for mixing epoxy ingredients in said bucket means;

(ii) mixer placement and support means for facilitating movement of said mixer means between said bucket means and for supporting said mixer in various operating positions within said bucket means and removed from said bucket means, said mixer placement and support means comprising:

a central vertically extending guide post, having a central vertical axis, fixedly mounted on said carraige between said first and second bucket assemblies;

mixer sleeve means closely slidingly mounted on said post, said sleeve means being slidingly vertically displaceable on said guide post and being rotatably displaceable relative the central vertical axis of said guide post; and mixer adjustable pivotal attachment means for adjustably attaching said mixer means to said mixer sleeve means and for allowing pivotal movement of said mixer means relative said sleeve means about a horizontally disposed axis; and (e) control means for independently controlling said first and second power driven bucket rotation means and said power driven epxoy mixer means.

2. An epoxy mixing and dispensing apparatus comprising:

a horizontally extending, generally rectangular, wheel mounted carriage having a central longitudinal axis;

a plurality of mixing and dumping bucket assemblies mounted in spaced relationship on said wheel mounted carriage, each of said bucket assemblies being pivotable about a longitudinally extending dump axis parallel to said carriage central longitudinal axis; each said bucket assembly comprising a main support member having a horizontally and longitudinally extending central portion and a pair of normally vertically extending arm portions, each said arm portion being fixedly attached to a horizontally and longitudinally extending pivot pin defining said longitudinally extending dump axis, each said pivot pin being journalled for pivotal rotation to a structural support member fixedly attached to said carraige; each said bucket assembly further comprising a support bracket fixedly attached to said main support member and pivotally movable therewith about said longitudinally extending dump axis; each said support bracket supporting a bucket rotating electrical motor attached in fixed relationship thereto; each said bucket rotating electrical motor being drivingly linked to a bucket drive gear fixedly attached to a bucket frame in turn rotatably mounted on said main member about a normally vertically oriented forwardly pivotable bucket rotation axis; each said bucket frame being adapted to clampingly receive a bucket therein for rotation therewith and pivotal dumping movement therewith; each said mixing and dumping bucket assembly further comprising a generally vertically extending dump handle fixedly attached to an outboard portion of said main frame member; and at least one mixer assembly comprising a mixer having a mixer blade disposed at the end of an elongate mixer shaft, said mixer shaft being rotatably attached to and driven by an electrical mixer motor and having a direction of rotation opposite to the direction of said bucket rotation, said mixer motor being adjustably pivotally mounted for pivotal movement about a horizontally disposed pivot axis on a mixer sleeve, said mixer sleeve being slidingly received on a tubular guide post, said tubular guide post being vertically erect and mounted on a central portion of said carriage between at least two of said mixing and dumping bucket assemblies, with said mixer sleeve being vertically slidable on said tubular guide post whereby said mixer blade is vertically insertable into and removable from an epoxy bucket, said mixer sleeve being rotatable about the central vertical axis of said tubular guide post whereby said mixer is pivotable about said central vertical axis from a position above one of said buckets to a position above the other said bucket.

3. The invention of claim 1 wherein said bucket means comprises:

a bucket frame; and a removable bucket clampingly attachable to said bucket frame.

4. The invention of claim 1 wherein said placement and support means comprises:

a counterweight operably attached to said mixer sleeve means by a cable and pulley assembly and slidably mounted within a tubular cavity portion of said central vertically extending guide post for facilitating vertical movement of said mixer means; and mixer sleeve stop means for limiting the downward movement of said mixer sleeve means and for supporting said sleeve means at an elevation on said central guide post adapted to place said mixer blade at a proper elevation for mixing the epoxy ingredients in said bucket means.

5. The invention of claim 1 wherein said control means comprise an on/off switch for each of said power driven means.

6. The invention as defined in claim 2 and wherein said mixer sleeve being attached by a cable and pulley assembly to a counterweight slidingly mounted in a central cavity portion of said central tubular guide post for facilitating vertical sliding movement of said mixer sleeve; said mixer central tubular guide post having a sleeve stop mounted thereon for limiting downward movement of said sleeve to a position associated with optimum vertical mixer placement relative the bottom of an epoxy bucket.

7. The invention as defined in claim 2 and further comprising:

a plurality of control switches for independently controlling each of said bucket rotating electrical motors and said mixer motor.

* * * * *